United States Patent [19]

Tapp et al.

[11] Patent Number: 5,049,261

[45] Date of Patent: Sep. 17, 1991

[54] PORTABLE COAL SLURRY WASHER

[76] Inventors: Eddie D. Tapp, Pine St.; Tony L. Tapp, 13016 Hopkinsville Rd., both of Nortonville, Ky. 42442

[21] Appl. No.: 451,799

[22] Filed: Dec. 18, 1989

[51] Int. Cl.[5] ..... B03B 7/00

[52] U.S. Cl. ..... 209/17; 209/11; 209/211; 209/421; 209/935; 210/237; 210/241

[58] Field of Search ..... 209/11, 17, 935, 273, 209/211, 420, 421; 210/241, 237

[56] References Cited

U.S. PATENT DOCUMENTS

| | | | |
|---|---|---|---|
| 3,870,489 | 3/1975 | Shaddock | 209/421 X |
| 3,909,401 | 9/1975 | Thompson | 209/421 X |
| 4,164,467 | 8/1979 | Liller | 209/211 X |
| 4,200,535 | 4/1980 | Kennedy, Jr. | 210/241 |
| 4,227,997 | 10/1980 | Shaddock | 209/421 X |
| 4,378,290 | 3/1983 | Kennedy, Jr. | 209/17 X |
| 4,505,811 | 3/1985 | Griffiths et al. | 209/17 |

FOREIGN PATENT DOCUMENTS

| | | | |
|---|---|---|---|
| 0353034 | 1/1990 | European Pat. Off. | 210/241 |
| 0028060 | 3/1977 | Japan | 210/241 |

*Primary Examiner*—Donald T. Hajec
*Attorney, Agent, or Firm*—Warren D. Flackbert

[57] ABSTRACT

A coal slurry washer which, importantly, is portable for usage at the site of the coal slurry, where the components are disposed on movable platforms capable of highway travel. A mast or boom is provided which carries, at the free upper end thereof, cyclone-sieve bend components, assuring an effective elongated gravity discharge path to a dryer component therebelow. The platform carrying the mast provides space for receiving the cyclone-sieve bend components during a non-use or transporting position of the latter, further assuring the desired portability.

8 Claims, 4 Drawing Sheets

PORTABLE COAL SLURRY WASHER

As is known, coal slurry is always abundant at a coal production site, where the cleaning of such would add significantly to total coal recovery. A washer plant, limited to slurry, would typically be stationary, requiring on-site component assembly and subsequent disassembly when the slurry source becomes exhausted.

The preceding presents a considerable problem to an operator/producer mainly concerned with strip-mining, and particularly where the principal concern is to present usable/marketable slurry, available as an addition to the mined coal seam.

Moreover, in the instance of relatively small strip-mining operations, the trucking of slurry to an existing, and possibly remote, washer plant proves costly and mostly inefficient. The need has arisen, therefore, for a portable coal slurry washer, i.e. one movable to different mining locations.

BRIEF DESCRIPTION OF THE INVENTION

The invention satisfies the aforesaid need in presenting a self-contained portable coal slurry washer which, typically, is mounted on two platforms each movable, by a tractor, to any desired operational site. In addition to ease in highway transporting due to proper dimensioning, the portable coal slurry washer of the invention can be readily assembled proximate a source of slurry for the desired washing.

In other words, the arrangement of the system is such as to recover coal from slurry, a procedure which would not be otherwise economically feasible to achieve without the instant portability feature. More specifically, the coal washer arrangement of the invention utilizes two tractor movable platforms, one of which mounts the principal components, i.e. a boom which carries commercially available cyclones and sieve bends at the distal or remote end in an overlying relationship with dryers. A movable belt arrangement, beneath the dryers, carries the washed and dried slurry, as a finished product with a marketable value, onto, for example, waiting carriers. The other platform carries a storage tank, controls and pumps which move the slurry into and through the washing operation.

A unique feature of the invention is in connection with the boom, i.e. the position of the cyclones and sieve bends thereon, which, further, is movable from a non-use to a use condition, and conversely, through hydraulic power. The arrangement is such that the boom is positively mounted at a non-use or transporting position, where, at the same time, the width of such and the cyclones and seive bends importantly carried on and movable with such do not extend beyond the width of the platform, i.e. readily permit highway travel and, thus, ease in movement from one operational site to another.

In other words, the combination of platforms, typically used in a side-by-side relationship, equals, in end results, the capacity of a stationary coal slurry washer, but, with the added versatility for usage at sites formerly unavailable, economically, for slurry washing activities.

DESCRIPTION OF THE FIGURES

In any event, a better understanding of the present invention will become more apparent from the following description, taken in conjunction with the accompanying drawings, wherein.

Figure 1:
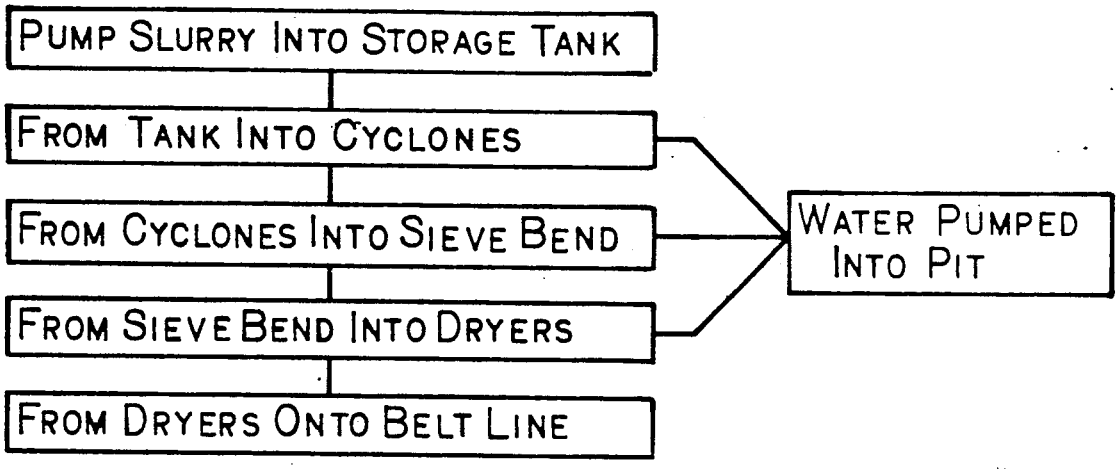
FIG. 1 is a block diagram illustrating slurry movement through a coal slurry washer assembled in accordance with the teachings of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the coal slurry washer of the invention is basically presented by components including movable platforms 12 and 22, a slurry receiving/storage tank 14; various pumps 25 (depending upon installation requirements); controls (not detailed); commercially available cyclones 15, sieve bends 17 and dryers 19; and, a flexible type of movable discharge belt arrangement 20.

In a typical invention embodiment, the slurry receiving/storage tank 14 and the pumps 25 are mounted on platform 12, where the remaining components are mounted on platform 22. Platforms 12 and 22 are actually side-by-side at an operating site, and each is movable by a tractor (shown, for example, in phantom in FIG. 4).

Figure 2:
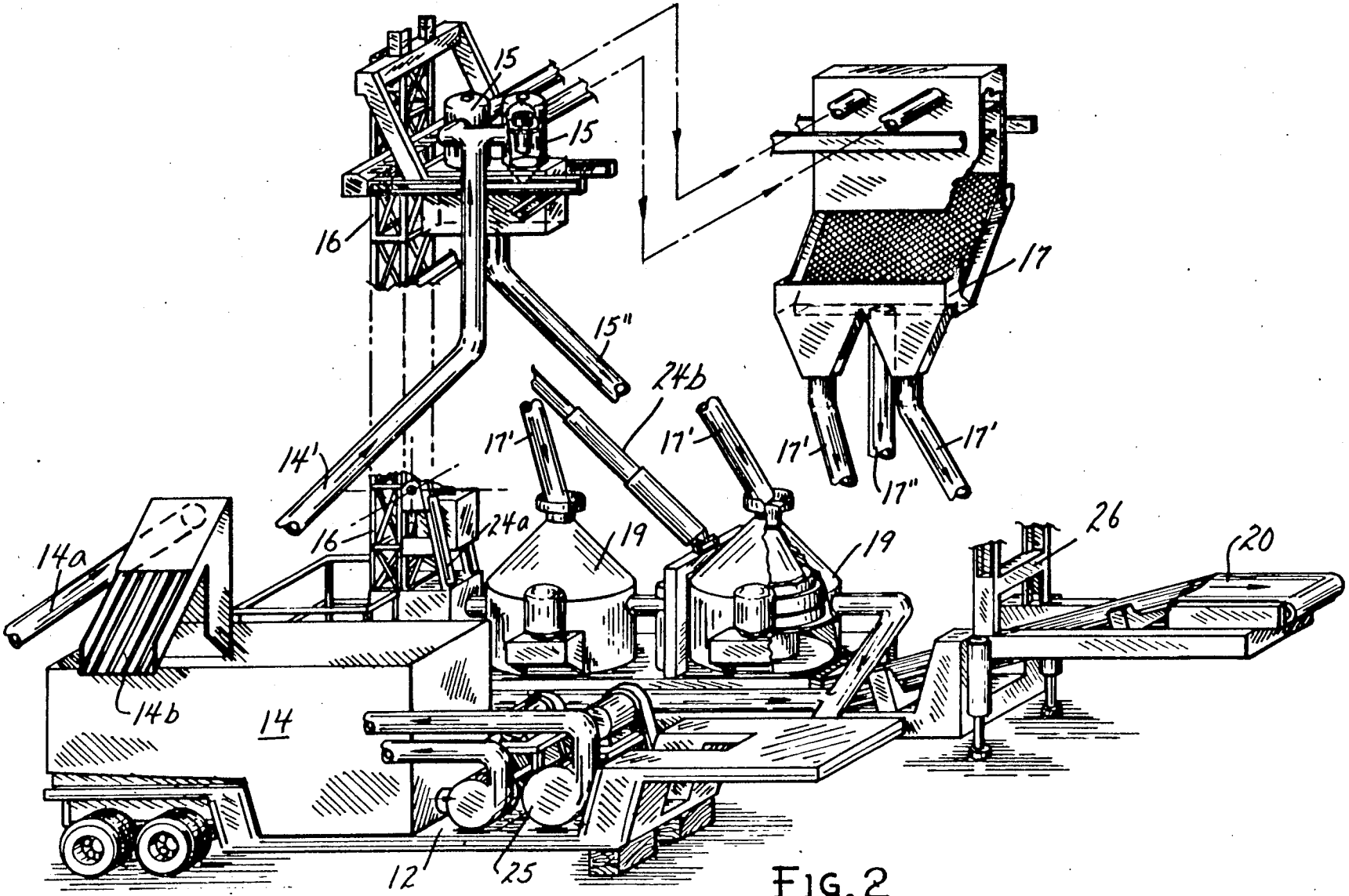
FIG. 2 is an isometric view showing the instant coal slurry washer at a use site and in a use condition.

Looking first at FIG. 2, the above enumerated components are shown as grouped at a slurry site, i.e. an operative washing location. Importantly, a mast or boom 16 is pivotally mounted, at 16*a*, on platform 22, where movement of such from an inoperative position (FIG. 4) to an operative position (FIGS. 3 and 6) is achieved by hydraulically operated pistons 24*a* and 24*b*.

The mast or boom 16 carries commercially available cyclones or cyclone equipment 15 at the free outer end thereof, where such location serves importance for at least two reasons, to-wit, a longer gravity feed passage from the outlet end of each cyclone 15, including sieve bends 17 (conduits 17'), to dryers 19, and for placement reasons, i.e. each cyclone 15 is at a location proximate the pulling end of platform 22 for transporting or non-use.

Figures 3, 5, 9:
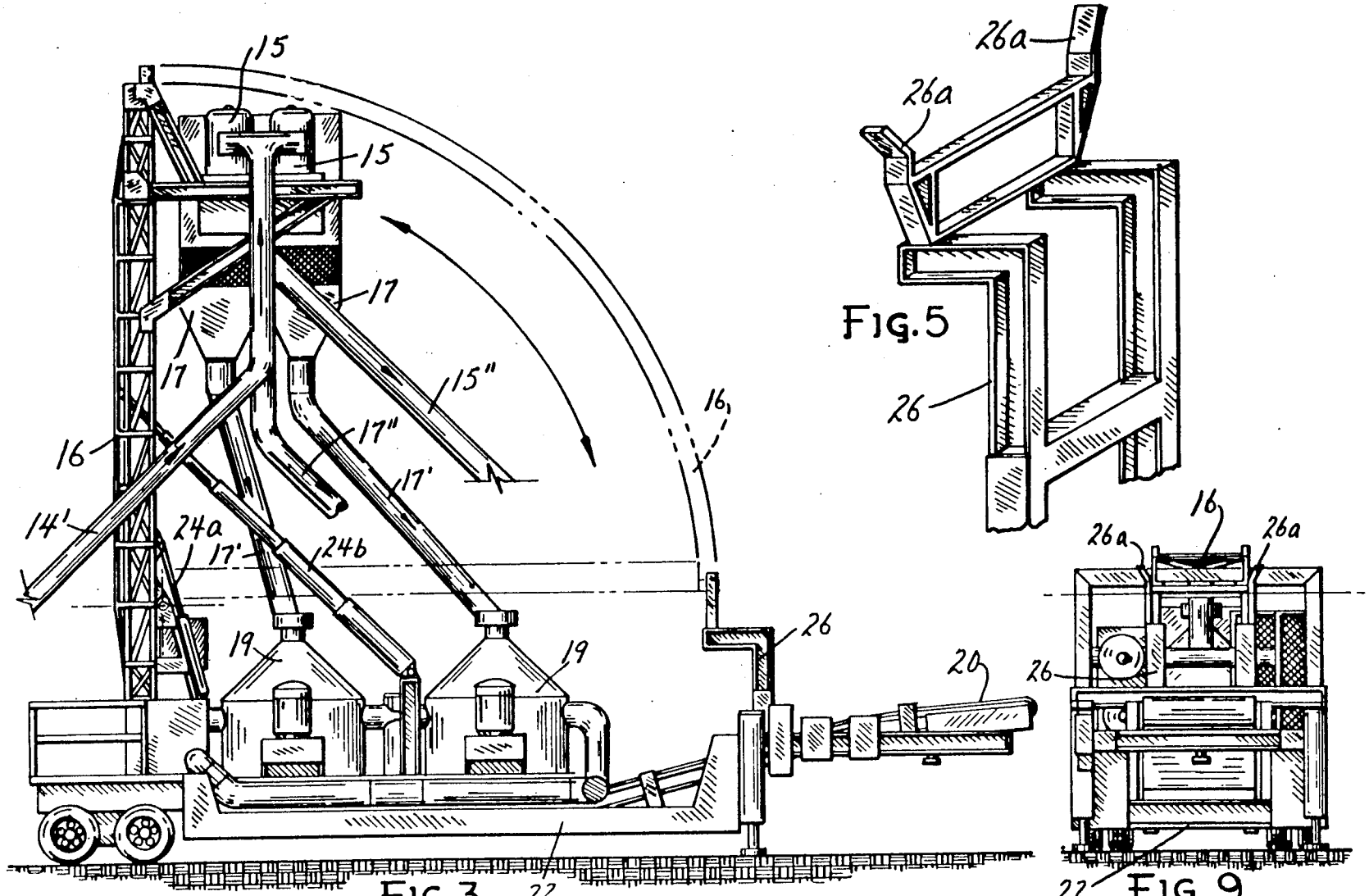
FIG. 3 is a view in side elevation detailing the boom forming part of the washer at a use condition.
FIG. 5 is a perspective view, looking from right to left on FIG. 3, detailing a frame member supporting the upper end of the boom at a non-use or transporting condition.
Figure 6:
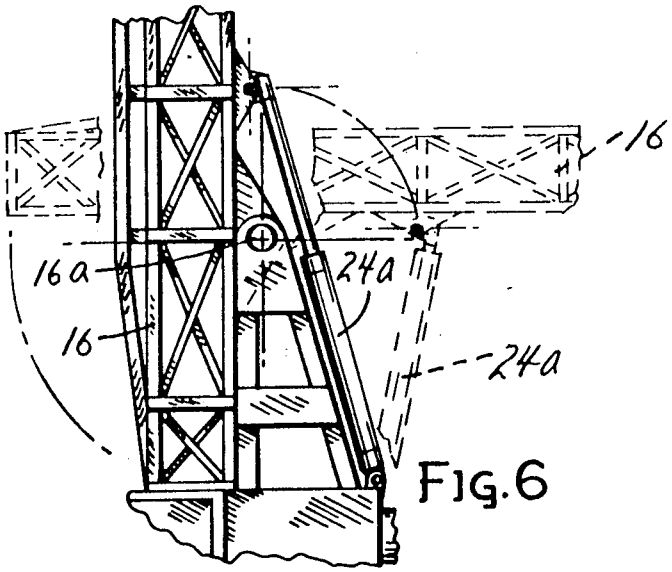
FIG. 6 is an enlarged and detailed view of the boom pivot arrangement, where the broken lines illustrate a non-use or transporting position.
Figure 4:
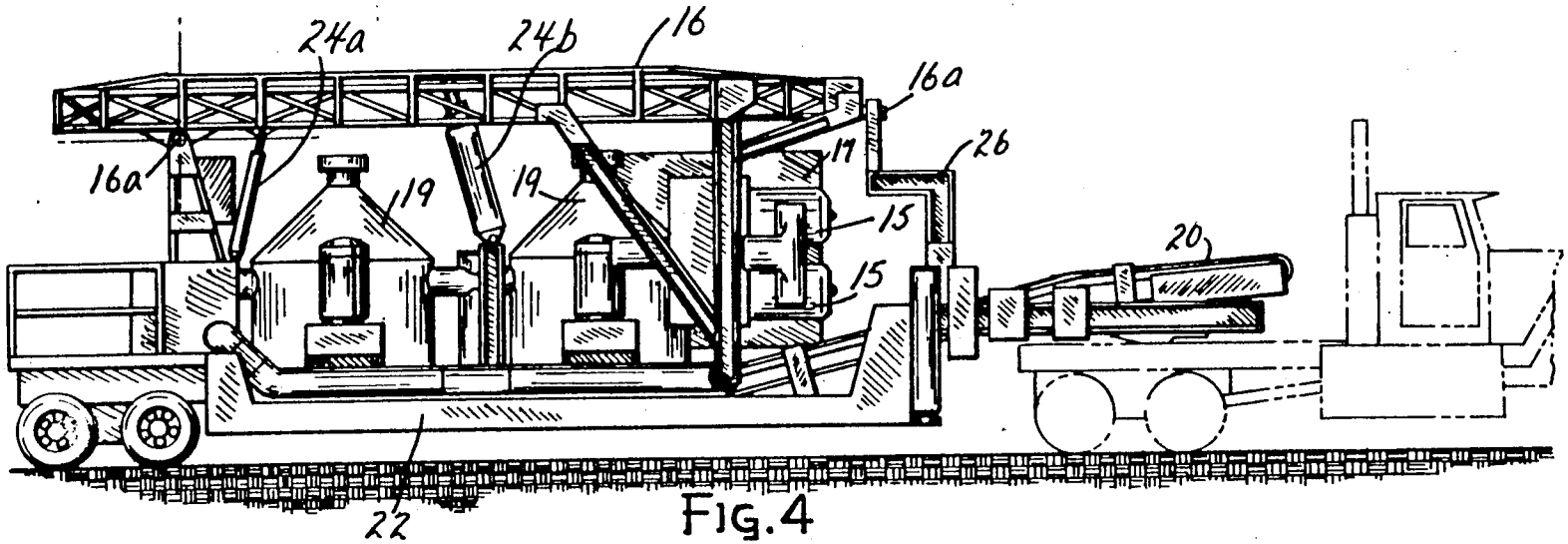
FIG. 4 is another view in side elevation, comparable to that of FIG. 3, but showing the boom lowered to a non-use condition.

In other words, and as should be apparent from FIGS. 3 and 4, the geometry of the arrangement is such as to permit sufficient direct slurry flow access between cyclones 15-sieve bends 17, and to the dryers 19 at the operable position of the mast or boom 16, and adjacent the latter in the instance of a non-operative mast or boom 16 position.

Figure 8:
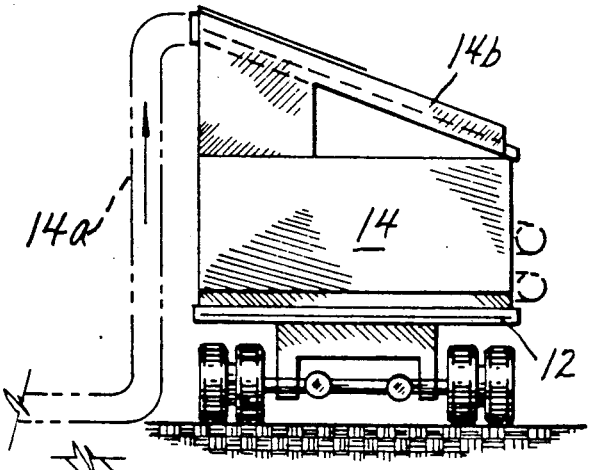
FIG. 8 is a view in end elevation, looking from left to right in FIG. 7, further detailing the washer; and, FIG. 9 is another view in end elevation, looking from right to left in FIG. 4, again detailing the instant coal slurry washer at a non-use and/or transporting condition.
Figure 7:
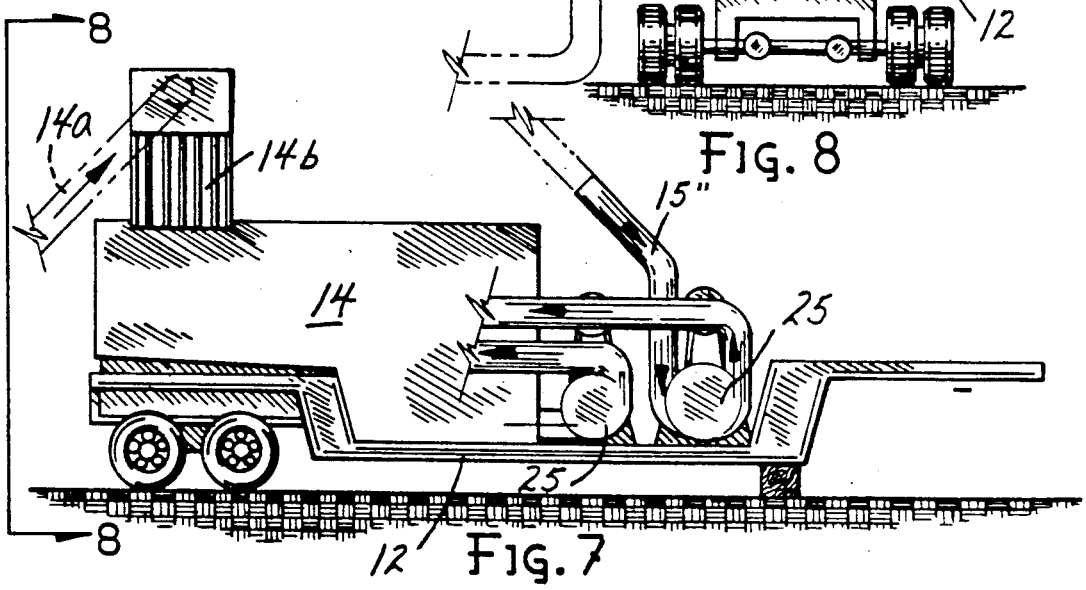
FIG. 7 is another view in side elevation showing the platform of the instant coal slurry washer which positions the slurry receiving/storage tank.

With reference now to FIGS. 4, 5 and 8, and particularly FIG. 5, the latter illustrates a structure 26 serving holding and/or positioning purposes, i.e. such receives free end 16*a* of the mast or boom 16 between arms 26*a*. Placement of member 26 is critical to the extent that all components should be combinable within the lateral width of each platform 12 and 22 (see FIGS. 7 and 8, for example).

Thus, member 26 serves important guiding and/or placement purposes and, in combination with the raising/lowering pistons 24*a* and 24*b*, retains the mast or boom 16 at the proper position during transport. Again, it should be noted that as mast or boom 16 carries the cyclones 15, the positive placement of the cyclones 15 adjacent the platform 22 during a transporting position is critical, i.e. such must lie within the space between the dryers 19 and the mounting structure 26.

Looking now at the arrangement on platform 12, the slurry receiving/storage tank 14 is included thereon together with pumps 25 and other needed controls (not shown). Slurry, from a source (also not shown), is pumped upwardly through an inlet conduit 14*a*, where an initial or preliminary screening takes place within structure forming part of the receiving/storage tank 14, i.e. the moving slurry is dumped onto a screen (not shown) which permits entry of the smaller size slurry into the tank 14, where the larger size slurry passes along ramp 14*b* onto a refuse area (again, not shown).

Pumps 25 then move the slurry from the receiving/storage tank 14 upwardly to the cyclones 15 (conduit 14'), where a further separation is achieved. The desirable to-be-recovered slurry passes to the sieve bends 17 and the other unwanted slurry passes (conduit 15''), by gravity, to a pump 25, and then pumped to a refuse area. Cyclones 15 are commercially available and, accordingly, will not be detailed herein, except to the extent that centrifugal forces create the desired slurry separation.

The further screened slurry then passes through sieve bends 17, by gravity, and through conduits 17' into the dryers 19 (again see FIGS. 2 and 3). Moisture is removed from the slurry and the remaining dried coal drops onto the movable discharge belt 20 for ultimate passage into a transport vehicle (not shown).

In other words, and simply stated, the invention achieves significant coal recovery from what normally would be waste and, thereby, provides a greater volume of marketable product. Since, as a practical matter, a source of slurry cannot be readily moved, the reclamation device of the invention is moved to the source and is movable from source to source. Thus, a heretofore undeveloped source of natural coal is the significant result.

The coal slurry washer described hereabove is susceptible to various changes within the spirit of the invention, including, by way of example, individual component proportioning; the types of platforms involved; individual working characteristics of each of the components; and, the like, as long as an extended gravity flow discharge line extends between the cyclones-sieve bends and the dryer(s), spaces are provided on the platform for receiving the cyclones/sieve bends at a non-operative or transporting position, and all components are confined within the lateral dimension of each platform to assure ready highway portability. Thus, the preceding should be considered illustrative and not as limiting the scope of the following claims:

We claim:

1. A coal slurry washer comprising a portable platform, a mast including a pivotal end mounted on said platform and an opposite free end, means moving said mast from an operative position to a non-operative position, a cyclone mounted proximate said free end of said mast, and means introducing slurry to said cyclone, and other means discharging recovered coal from said cyclone, where a dryer is mounted on said portable platform, and where a vacant area on said portable platform between said dryer and said free end of said mast when said mast is at said non-operative position presents storage space for said cyclone.

2. The coal slurry washer of claim 1 where said means pivotally moving said mast to and from said operative position and said non-operative position are hydraulic.

3. The coal slurry washer of claim 1 where said slurry introducing means is a pump.

4. The coal slurry washer of claim 1 where said other means is gravity.

5. The coal slurry washer of claim 4 where said gravity discharge presents an extended flow path.

6. The coal slurry washer of claim 1 where said mast and said cyclone are confined within the lateral dimension of said portable platform when at both said operative position and said non-operative position.

7. A coal slurry washer comprising a portable platform, a mast including a pivotal end mounted on said platform and an opposite free end, means moving said mast from an operative position to a non-operative position, a cyclone mounted proximate said free end of said mast, and means introducing slurry to said cyclone, and other means discharging recovered coal from said cyclone, where a sieve bend connects to and moves with said cyclone, where a dryer is mounted on said portable platform, and where a vacant area on said portable platform between said dryer and said free end of said mast when said mast is at said non-operative position presents storage space for said cyclone and said sieve bend.

8. The coal slurry washer of claim 7 where said mast, said cyclone and said sieve bend are confined within the lateral dimension of said portable platform are both said operative position and said non-operative position.

* * * * *